United States Patent [19]

Hammer et al.

[11] 3,961,107

[45] June 1, 1976

[54] FIBER FLEECE CONTAINING A POLYMERIC REINFORCING MATERIAL, AND PROCESS FOR THE PRODUCTION OF SUCH FLEECE

[76] Inventors: Klaus-Dieter Hammer, Kettelerstrasse 8, 6501 Finthen; Herbert Porrmann, Imkerweg 10, 6272 Niedernhausen; Ludwig Klenk, Am Rebhang, Jungfernweg 10, 6229 Hallgarten, all of Germany

[22] Filed: Nov. 11, 1974

[21] Appl. No.: 522,743

Related U.S. Application Data

[60] Continuation of Ser. No. 312,686, Dec. 6, 1972, abandoned, which is a division of Ser. No. 192,899, Oct. 27, 1971, Pat. No. 3,811,923.

[30] Foreign Application Priority Data

Oct. 30, 1970 Germany ..... 2053497
Oct. 30, 1970 Germany ..... 2053442

[52] U.S. Cl. ..... 427/246; 8/130.1; 8/DIG. 4; 427/381; 427/390

[51] Int. Cl.[2] ..... D06M 1/00; B05D 5/00; B05D 3/02

[58] Field of Search ..... 427/381, 390, 246; 8/130.1, DIG. 4

[56] References Cited

UNITED STATES PATENTS

| | | | |
|---|---|---|---|
| 3,053,609 | 9/1962 | Miller | 8/128 |
| 3,236,586 | 2/1966 | Humphreys | 8/130.1 |
| 3,236,587 | 2/1966 | Genereux | 8/130.1 |
| 3,291,561 | 12/1966 | Abashian | 8/130.1 |
| 3,403,969 | 10/1968 | Kautny et al. | 8/130.1 |
| 3,434,794 | 3/1969 | Tovey | 427/381 X |
| 3,674,539 | 7/1974 | Parisot et al. | 8/130.1 X |

*Primary Examiner*—Michael R. Lusignan
*Attorney, Agent, or Firm*—James E. Bryan

[57] ABSTRACT

This invention relates to a fiber fleece based on synthetic fibers and containing a polymeric organic reinforcing material, and having, at a proportion of polymeric elastic reinforcing material of at least 10 per cent by weight and not more than 80 per cent by weight, calculated on the total weight of a base fleece having a density between 0.1 and 0.28 g/cm$^3$, a tensile strength of at least 0.01 kg/mm$^2$, a tear propagation resistance of at least 7 kg/mm (according to IUP 8), and a tensile stress or not more than 0.03 kg/mm$^2$, measured in a tensile elongation test at an elongation of 10 per cent.

23 Claims, 1 Drawing Figure

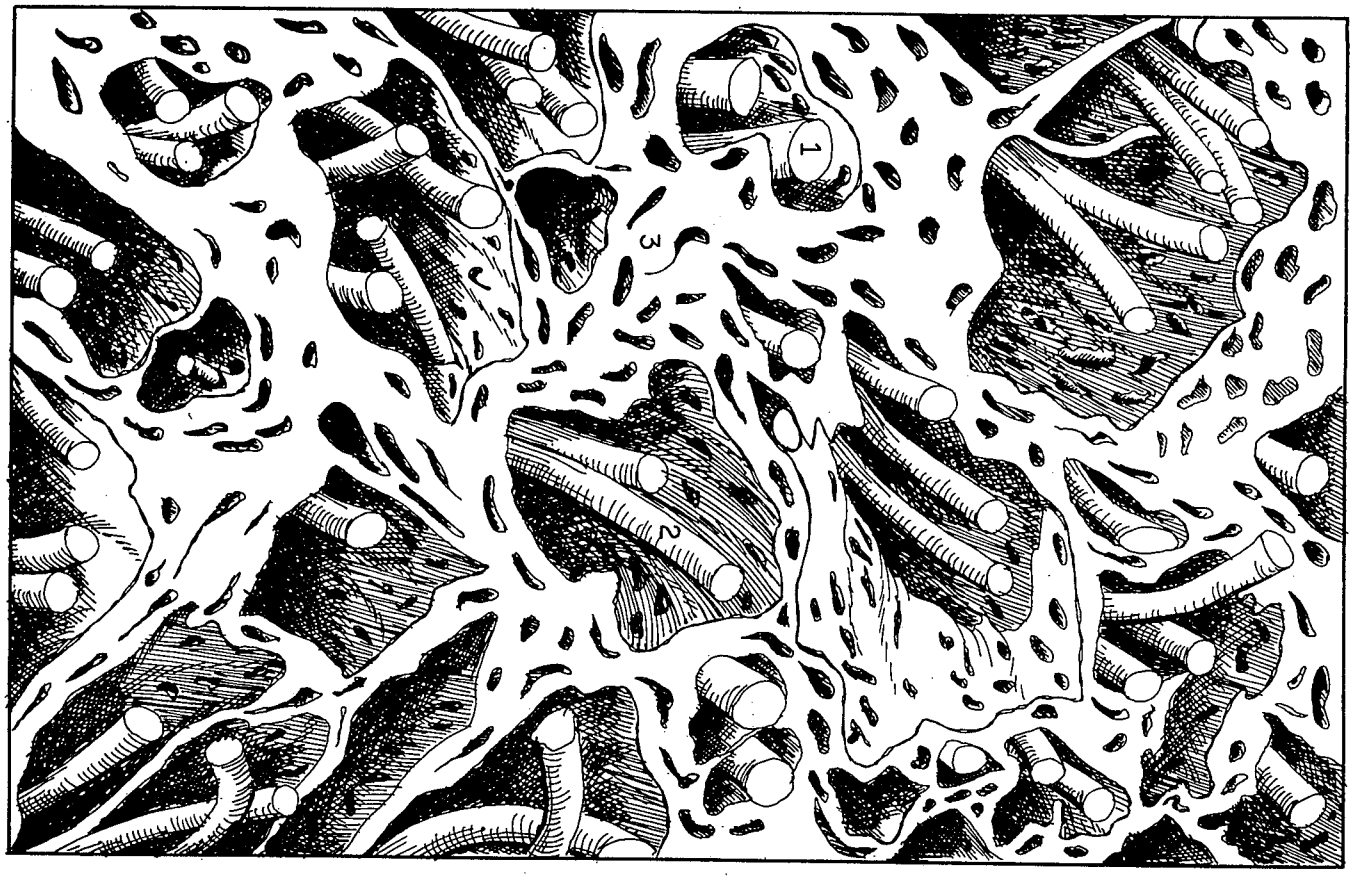
1
2
3

FIBER FLEECE CONTAINING A POLYMERIC REINFORCING MATERIAL, AND PROCESS FOR THE PRODUCTION OF SUCH FLEECE

This is a continuation of application Ser. No. 312,686, filed Dec. 6, 1972, now abandoned, which, in turn, is a division of Ser. No. 192,899, filed 10/27/71, now Pat. No. 3,811,923, patented 5/4/74.

The present invention relates to a fiber fleece which contains a polymeric elastic reinforcing material. Further, the invention relates to a process for the production of such fiber fleece.

Furthermore, the present invention is concerned with the use of a fleece of this type as an intermediate product for the manufacture of a leather substitute, the leather substitute being produced by applying a microporous covering layer of plastic material, preferably of polyurethane, to the fleece.

Fiber fleeces are known in which the fibers are bonded by means of an adhesive. Fleeces bonded in this manner have the desired high tensile strength, but they are very stiff and, therefore, cannot be used for application purposes where a soft feel of the material or the formation of textile-like folds are a prerequisite, or where it is required that the material have the suppleness of leather.

Other known fiber fleeces contain elastomers as binders, so as to avoid the drawbacks of the above described fleeces. Fleeces whose fibers are bonded by means of elastomers incorporated therein are elastic, but they have the disadvantage of being of rubber-like character, and are thus less suitable as a base material for processing into a leather substitute.

None of the known fiber fleeces has the foldability and drapability of textile materials, or possesses the soft feel and flexibility resembling those of natural leather.

The present invention provides a fiber fleece which does not have the drawbacks of the known, chemically bonded fiber fleeces and which, because of its physical characteristics, its drapability and its flexibility, is suitable as a base material for processing into air-permeable multilayer materials from which shoe uppers, garments, upholstery materials, and fancy leather articles can be manufactured.

Further, the invention is concerned with a process for the production of such fleece.

The fiber fleece of the invention contains an organic polymeric reinforcing material and, at a proportion of reinforcing material of at least 10 per cent by weight and at the most 80 per cent by weight, based on the total weight of a base fleece having a density in the range from 0.1 to 0.28 g/cm$^3$, the fiber fleece has a tensile strength of at least 0.01 kg/mm$^2$, a tear propagation resistance of at least 7 kg/mm, and a tensile stress of not more than 0.03 kg/mm$^2$, measured at an elongation of 10 per cent in a tensile elongation test.

Further, the invention is concerned with the use of the fleece according to the invention as a base material for the manufacture of air-permeable synthetic material of leather-like characteristics, in sheet form, for the manufacture of garments, shoes, upholstery materials, and fancy leather articles. The particular characteristics of the fleece according to the invention are a result of its physical parameters, and the parameters are caused by the particular structure of the fleece. In the fleece, the individual fibers are coated with a synthetic material whose adhesion to the fiber surface is such that it cannot be washed away, whereas it has no adhesion, or substantially no adhesion, towards the organic elastic polymeric reinforcing material adjacent to it, which permeates the fleece and surrounds the individual fibers of the fleece.

In the process for the production of the above-described fiber fleece - which at a proportion of polymeric elastic reinforcing material of at least 10 per cent and at the most 80 per cent by weight, based on the total weight of a base fleece with a density in the range from 0.1 to 0.28 g/cm$^3$, has a tensile strength of at least 0.01 kg/mm$^2$, a tear propagation resistance of at least 7 kg/mm (measured by IUP 8), and a tensile stress of not more than 0.03 kg/mm$^2$, measured at an elongation of 10 per cent in a tensile elongation test - in a first process step, a liquid solution or dispersion of a synthetic substance capable of forming a coating on the fibers is caused to act upon the fleece; heat sufficient for evaporation of the solvent or dispersing agent and for the formation of a wash-proof coating of the substance on the fibers is then caused to act upon the fleece; the impregnated fleece is then treated with a liquid solution or dispersion of a polymeric elastic reinforcing agent; the polymer is then coagulated in known manner, and the fleece is finally dried.

In another modification of the above described process, which is within the scope of the present invention and is even preferred, an impregnating liquid containing liquid halogenated hydrocarbons, benzene compounds with free phenolic OH groups as swelling agents for the fibers, and a coating substance for the fibers of the fleece, which contains esters of higher fatty acids and polyhydric aliphatic alcohols or of multi-valent aliphatic carboxylic acids and long-chain aliphatic alcohols, in which liquid the proportion of chemical coating substance exceeds that of the swelling agent, i.e. the benzene compound with the free phenolic groups, or both components are present in equal quantities, is caused to act upon the fleece in the first process step; the fleece is then freed from excess impregnating liquid by rinsing with a solvent and then heated for a period of time ranging from 30 seconds to 10 minutes to a temperature between 100° and 180° C.; a liquid solution or dispersion of a polymeric elastic reinforcing material is then caused to act upon the impregnated material; the polymeric reinforcing material is then coagulated in known manner; and the fleece is then dried by heating it for a period ranging from 2 to 30 minutes to temperatures between 100° and 180° C.

According to the present invention, the above-described preferred modification of the process may be further varied, in a particularly advantageous manner, in that an impregnating liquid is caused to act upon the fleece in which the proportion of swelling agent exceeds that of the coating substance, the fleece is then rinsed in order to free it from excess impregnating liquid, dried at room temperature, and then further treated as described above.

This particularly advantageous embodiment of the invention may be further modified in that, after impregnation and removal of excess impregnating liquid, the fleece is subjected for 30 seconds to 10 minutes to a heat treatment at temperatures ranging from 100° to 180° C., and that the process is then completed as described above.

Suitable fleeces which may be used as base materials for performing the process of the invention are matted fiber fleeces based on synthetic fibers. They consist either exclusively of synthetic fibers, or half of their fibers are synthetic fibers and the other half are natural fibers, or they are predominantly composed of synthetic fibers and contain only a small proportion of natural fibers. Advantageously, the fleeces are densified by needling, a needling rate of 200 to 600 stitches per $cm^2$ being preferred. The synthetic fibers contained in such fleeces may be of polyacrylonitrile, of polyamide, or of polypropylene, and in particular of fibers of such materials which are capable of longitudinal shrinkage under the influence of heat. Polyethylene terephthalate fibers having this characteristic are particularly advantageous.

Suitable mixed fiber fleeces are those which contain from 75 to 50 per cent by weight of polyester fibers and 25 to 50 per cent by weight of chemically different synthetic fibers, for example polyamide fibers, polyacrylonitrile fibers, or polypropylene fibers, a mixing ratio of 1 : 1 between polyester fibers and chemically different fibers being preferred. Further, fibers may be used which consist of polyester fibers in the proportion stated above, and natural fibers.

Suitable natural fibers are fibers of wool or other animal hair, as also cotton, hemp, jute, sisal or flax fibers.

The synthetic fibers have a thickness of 0.8 to 3.5 dtex, preferably between 1.2 and 1.7 dtex.

The base fleece has a density in the range from 0.1 $g/cm^3$ to 0.28 $g/cm^3$, preferably from 0.14 to 0.2 $g/cm^3$. The expression "base fleece" means a needled fleece containing neither a coating substance nor a reinforcing material.

The needled fleeces have a weight per unit area in the range from 50 to 400 $g/m^2$, preferably in the range from 100 to 250 $g/m^2$.

Suitable reinforcing materials are elastic polymers, such as synthetic rubber, polyacrylates, especially elastomers, and most advantageously butadiene-acrylonitrile-methacrylic acid copolymers, and polyurethane. Natural rubber also may be used as a reinforcing material.

Elastic polymers are those polymers which show a plastic-elastic solidification behavior similar to that of rubber within a temperature range between −20° C. and +50° C. The expression "elastomers" means the polymers listed on page 154 of "Textbook of Polymer Chemistry", New York, 1957 (Bielmeyer).

The reinforcing material is introduced into the fleece in the form of a liquid solution or dispersion of an elastic polymer, for example by impregnating the fleece with the liquid. Suitable solvents or dispersing agents for the polymer reinforcing material are only those which do not dissolve or swell the fibers of the fleece.

The following solvents may be used for the preparation of a liquid solution of the polymeric elastic reinforcing material: dimethyl formammide, dimethyl sulfoxide, and, in the case of polyurethane, tetrahydrofuran. Water may be used as a dispersing agent for synthetic rubber or acrylate dispersions.

The solution or dispersion of the high-polymer elastic reinforcing material has a solids content in the range of 10 to 70 per cent by weight.

The density of the fleece is determined by the IUP 5 method.

The fleece according to the invention contains a proportion of reinforcing material of 10 to 80 per cent by weight, based on the total weight of the fleece, the preferred range being from 30 to 65 per cent by weight.

The fleece according to the invention which contains a polymeric elastic reinforcing material has a weight per unit area in the range of 60 to 600 $g/m^2$, preferably in the range from 200 to 600 $g/m^2$.

The liquid which contains the synthetic coating substance and is applied to the fleece during the first process step, will be designated in the following as the "impregnating liquid".

The expression "synthetic coating substances" includes those chemical substances which are capable of forming on the surface of the fibers a coating which, after sufficient heat action upon the fibers coated with the substance, forms a wash-proof union with the fiber surface, due to the good adhesion between the fiber surface and the coating caused by heat action.

Examples of suitable coating substances, which may be applied in the form of solutions or dispersions in solvents or dispersing agents which do not swell the fibers of the fleece, are the following: ethylene ureas of the following general formula

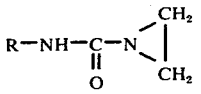

wherein

R is an aliphatic chain with 14 to 22 carbon atoms.

Fatty amines with a carbon chain of 16 to 18 carbon atoms, paraffins, etherified fat-modified synthetic resins having side chains with 12 to 18 carbon atoms, cross-linkable and non-cross-linkable silicones, such as dimethyl polysiloxane and hydrogen-methyl-polysiloxane, or cross-linkable polymeric compounds suitable for textile finishing treatments, which have perfluorinated aliphatic side chains (e.g. "Scotchgard", a product of Minnesota Mining and Manufacturing Co., St. Paul, Minn., USA), also may be used. Cross-linkable polymers which are suitable have perfluorinated aliphatic side chains containing from 6 to 14, preferably from 8 to 12 carbon atoms.

In a cross-linkable polymer containing carboxyl groups, e.g., the perfluorinated cross-linkable aliphatic side chain may be attached to the carboxyl group of the polymer via a sulfonamide group.

A fleece whose fibers have been impregnated with one of these coating substances will be designated in the following as the "impregnated fleece".

The fleece contains from 2 to 20 per cent by weight, preferably from 5 to 15 per cent by weight, based on the weight of the impregnated fleece, of a synthetic coating substance of the above-mentioned chemical structure which is capable of forming a wash-proof coating on the surface of the fibers.

The coating substance must have the inherent characteristic that there is no cohesion, or substantially no physical cohesion, between adjoining surfaces of the coating and of the reinforcing material, i.e. that the cohesion between these two surfaces is only such that a sliding displacement of the surfaces relative to each other is possible under the action of external mechanical forces upon the fleece, for example when the fleece is bent or stretched.

According to one modification of the inventive process, the coating substance is incorporated in the fleece in the form of a liquid solution or dispersion, for example by immersing the fleece in the liquid and then evaporating the solvent or dispersing agent, e.g. by causing sufficient heat to act upon the fleece. A bath ratio in the range of 1 : 10 to 1 : 50, preferably of 1 : 10 to 1 : 30, is most advantageous. For the preparation of a solution containing the coating substance, those solvents are preferred as do not dissolve or swell the fibers of the fleece, e.g. water.

Suitable dispersing agents for the preparation of the liquid dispersion of a coating substance are those which do not dissolve the fibers of the fleece, for example water.

The proportion of coating substance in the impregnating liquid used in the first process step is in the range from 2 to 30 per cent by weight, based on the total weight of the liquid, a range of 6 to 12 per cent by weight being preferred.

When the process is performed according to a further preferred embodiment, the impregnating liquid contains liquid halogenated aliphatic hydrocarbons, benzene compounds with free phenolic OH groups, and higher molecular weight fatty acids and polyhydric aliphatic alcohols, or multi-valent aliphatic carboxylic acids and long-chain aliphatic alcohols.

The liquid halogenated, preferably chlorinated, aliphatic hydrocarbons may be saturated or unsaturated. Suitable saturated chlorinated aliphatic hydrocarbons are, e.g., 1,1,1-trichloroethane and carbon tetrachloride. Liquid chlorinated unsaturated aliphatic hydrocarbons are preferred, however, in particular trichloroethylene and, above all, perchloroethylene. Mixtures of these hydrocarbons also may be employed.

The above-mentioned liquid halogenated hydrocarbons also may be used as solvents, for rinsing the impregnated fleece.

Benzene compounds with free phenolic OH groups which are particularly suitable are, e.g., p-cresol, o-cresol, oxybenzoic acid, and salicylic acid methyl ester; phenol is preferred.

Mixtures of these components may also be employed, for example a mixture of the preferred phenol with salicylic acid methyl ester.

The benzene compound with a free phenolic OH group, which is contained in the impregnating liquid, acts as a swelling agent for the fibers of the fleece.

As a further component, the impregnating liquid contains a chemical substance in the form of an ester, which is capable of forming a coating upon the fibers. The esters may be of higher molecular weight fatty acids and polyhydric aliphatic alcohols, in which case the fatty acid component of the ester may be unsaturated, but is preferably saturated. Alternatively, the esters may be of multi-valent aliphatic carboxylic acids and long-chain monovalent aliphatic alcohols. In this case, the aliphatic alcohols preferably are saturated, but also may be unsaturated. Mixtures of these esters also may be used.

The following chemicals are particularly suitable for forming a coating upon the fibers according to the preferred embodiment of the process: citric acid monostearyl ester, glycol-dioleate, but more preferably the glycol-monooleate, glycerol-distearate, and more preferably the glycerol-monostearate, erythritol-dipalmitate, and in particular erythritol-monopalmitate, sorbitol-monostearate, and sorbitol-distearate. Of these preferred coating substances, glycerol-monostearate can be used with particular advantage.

In the impregnating liquid according to the preferred embodiment of the invention, either the swelling agent, i.e. the benzene compound with the free phenolic OH group, is present in excess, or the chemical coating substance for the fibers, i.e. the above-mentioned esters, or the two components are contained in the impregnating liquid in equal quantities.

When the chemical coating substance is contained in the impregnating liquid in excess over the swelling agent, or when the two components are present in the impregnating liquid in equal quantities, the impregnated fleece is subjected for a period of 30 seconds to 10 minutes to a temperature between 100° and 180° C., after excess impregnating liquid has been removed by rinsing.

When the component of swelling agent exceeds that of the chemical coating substance in the impregnating liquid, the impregnated fleece is rinsed with a solvent and then dried at room temperature. Subsequently, the impregnated fleece obtained by one of these processes is soaked in a solution or dispersion of an elastomeric reinforcing material, the elastomer is coagulated, and the fleece is subjected for a period ranging from 2 to 30 minutes to a temperature between 100° and 180° C.

That modification of the process within the scope of the preferred embodiment, in which an impregnating liquid is used in which the quantity of the swelling agent for the fibers exceeds that of the coating substance for the fibers, yields particularly advantageous results as regards the easy displaceability of the fibers relative to the elastic reinforcing material surrounding them within the fleece. However, this modification requires a larger technical expenditure when performed on a commercial scale than does the other modification of the present process, in which an impregnating liquid is used wherein the substance used for coating the fibers is in excess of or equal to the swelling agent. This latter modification of the inventive process also yields chemically bonded fleeces which are excellently suited as base materials for the manufacture of synthetic leather, due to their very good fiber-binder separation, and are superior to known fleeces on account of their good qualities.

When using an impregnating liquid in which the chemical coating substance in the form of the ester component exceeds the quantity of the swelling agent component in the form of the benzene compound with a free phenolic OH group, or in which swelling agent and coating substance are present in equal quantities, wash-proof anchoring of the coating substance to the fibers of the fleece is effected by the heat-treatment from 30 seconds to 10 minutes at temperatures in the range from 100° to 180° C., which takes place after the fleece has been impregnated.

The effect of the fiber-binder separation may be considerably increased by using an impregnating liquid in which the quantity of swelling agent exceeds that of the coating substance, in which case de-swelling of the fibers of the fleece takes place only after the binder has been incorporated in the fleece, viz. during the drying process, while heat in the range of 100° to 180° C. is caused to act for a period of 2 to 30 minutes upon the fleece. By the de-swelling of the fibers, the cross-section of the swollen fibers is reduced. The coating substance disposed on the fibers and the reduction of the cross-section of the fibers which takes place after incorporation of the binder are responsible for the particularly easy relative displaceability between the fibers and the elastic reinforcing material surrounding them.

The coating substance is regarded as bonded to the fiber surface in a wash-proof manner, when the adhesion between the fiber surface and the coating substance is such that no separation, or substantially no separation, of the coating substance from the fiber surface can be observed when the material is mechanically washed five times at a temperature of 60° C. in accordance with DIN method No. 54010.

The following washing liquid is suitable: 5 grams of soap and 2 grams of calcined sodium carbonate per liter of fluid; washing time 30 minutes at 60° C.; bath ratio 1 : 50.

After its incorporation into the fleece, e.g. by precipitating the polymer in known manner from the polymer solution or dispersion, the polymeric reinforcing material is contained in the fleece not in the form of a plurality of discrete polymer particles, but instead forms a constant structure by which the pores of the fleece are more or less filled, depending upon the quantity of reinforcing material employed. The fibers are totally or partially surrounded by the reinforcing material. It is an essential feature of the present invention that between the surface of the fibers and the surface of the polymer reinforcing material surrounding them there is the coating substance which, on the one hand, adheres so firmly to the fiber surface that it cannot be washed off, while, on the other hand, there is no cohesion, or substantially no cohesion, between the surface of the coating substance and the surface of the polymer reinforcing material adjoining it, so that a parallel displacement of the two surfaces relative to each other is possible. In known fleeces bonded by polymeric binders, the binder permeates the fleece in a similar manner as in the fleece according to the invention, but the adhesive power between the surface of the fibers and the adjoining surface of the polymeric binder is so strong in known fleeces of this type that it is impossible to displace the fiber surface relative to the surface of the polymer binder surrounding it. However, in the case of the fleece according to the invention, such displacement is possible due to its particular structure. This particular structure is responsible for the paticularly advantageous physical data and the favorable qualities of the fleece according to the invention, which render it suitable for the purposes mentioned above.

In the following, the production of a fleece according to the invention will be described.

A needled matted fiber fleece consisting of polyester fibers is treated with a liquid solution or dispersion of a coating substance, for example by immersing the fleece in a bath consisting of the liquid and then removing excess liquid, e.g. by squeezing. For the soaking process, a bath ratio of 1 : 20 is of particular advantage. The fleece is then subjected for 2 to 20 minutes to a heat treatment at temperatures in the range from 100° to 180° C.

By this heat treatment, any dispersing agent or solvent present in the fleece is driven off, and on the other hand the heat action causes a wash-proof anchoring of the coating substance to the surface of the fibers. Heating of the fleece of performed in known manner, for example by using a tenter drier.

Subsequently, a liquid containing the high molecular weight polymeric elastic reinforcing material in dissolved or dispersed form is incorporated in known manner in the impregnated fleece. This may be effected, e.g., in an impregnating bath. The impregnating liquid has a solids content ranging from 10 to 70 per cent by weight, preferably from 30 to 50 per cent by weight of reinforcing material, calculated on the total weight of the liquid. The polymeric reinforcing material is then coagulated in the fleece. Coagulation may be caused, in known manner, by treatment of the impregnated fleece with a coagulating liquid which is miscible with the solvent or dispersing agent, but does not dissolve the polymeric reinforcing material.

Water may be used as a liquid coagulating agent, especially when the reinforcing material is dissolved in an organic, water-miscible solvent. When an aqueous dispersion of the reinforcing material is used, coagulation of the polymeric reinforcing material is caused, in known manner, by heat action.

After coagulation of the polymer reinforcing material, the fleece is substantially freed from the solvent or dispersing agent used for the polymer, e.g. by causing heat in the range of 100° to 180° C. to act upon the fleece until it is sufficiently dry. This heat treatment may take place, for example, in a drying cabinet or a tenter drier.

In the following, the method of producing a fleece by the above mentioned preferred modification is described.

A needled matted fiber fleece consisting of polyester fibers is treated with an impregnating liquid in which the quantity of chemical coating substance, i.e. the ester component, exceeds that of the swelling agent, i.e. the benzene compounds with free phenolic OH groups, or in which both components are present in equal quantities, for example by immersing the fleece in a bath containing the impregnating liquid. The fleece is then removed from the impregnating bath and freed from excess impregnating liquid by thoroughly rinsing it in a solvent bath.

For the impregnating process, a bath ratio of 1 : 20 is particularly advantageous. After impregnation and rinsing, the fleece is subjected for a period ranging from 10 seconds to 10 minutes to a heat treatment at temperatures ranging from 100° to 180° C.

In the course of this heat treatment, the volatile components of the impregnating liquid left between and in the fibers of the fleece are evaporated, and, on the other hand, the heat action causes a wash-proof anchoring of the coating substance to the surface of the fibers.

Subsequently, a liquid containing the polymeric elastic reinforcing material in dissolved or dispersed form is incorporated in known manner in the impregnated fleece, e.g. by means of an impregnating bath.

The impregnating liquid has a solids content in the range of 20 to 70 per cent by weight, preferably from 30 to 50 per cent by weight, of reinforcing material, based on the total weight of the liquid. The polymeric reinforcing material is then coagulated in the fleece. Coagulation may be caused in known manner, e.g. by treating the impregnated fleece with a coagulating agent which is miscible with the solvent or dispersing agent, but does not dissolve the polymeric reinforcing material.

Water is particularly suitable as a coagulating agent when the reinforcing material is dissolved in a water-miscible organic solvent. When an aqueous dispersion of the reinforcing material is used, the polymeric reinforcing material is coagulated in known manner by heat action, e.g. at temperatures in the range of 38° to 45° C.

After coagulation of the polymeric reinforcing material in the fleece, the fleece is substantially freed from the solvent or dispersing agent for the polymer, for example by heating it for 2 to 30 minutes to temperatures between 100° and 180° C. until it is sufficiently dry.

A drying cabinet or a tenter drier may be used for this heat treatment.

According to a particularly advantageous variation of the preferred modification of the process, an impregnating liquid is used in which the quantity of swelling agent exceeds that of the coating substance. In this case, the impregnated fleece is freed from excess impregnating liquid in the above described manner, dried at room temperature, and then the elastic polymeric reinforcing material is incorporated therein as described above.

After coagulation of the elastic polymeric reinforcing material by heat action, the fleece is subjected for a period from 2 to 30 minutes to heat action at temperatures between 100° and 180° C. Advantageously, this heat treatment takes place in a drying cabinet or a tenter drier supplied with hot air. With an impregnating liquid of the above described composition, the fibers are de-swollen by the heat treatment, i.e. the solvent and the swelling agent are removed from the fibers and their cross-section is reduced, thus separating the surfaces of the fibers from the polymeric reinforcing material surrounding them. At the same time, a wash-proof anchoring of the coating substance to the fiber surfaces is effected. These two effects combine in a particularly advantageous manner to provide the displaceability of the fibers relative to the elastic reinforcing material surrounding them.

The last-mentioned modification of the inventive process may be further modified in that, after impregnation of the fleece and removal of excess impregnating liquid, the fleece is subjected to a heat treatment for 10 seconds to 10 minutes, at temperatures of 100° to 180° C., and then further processed as described.

The invention will be further illustrated by reference to the accompanying drawing which shows the reinforced fleece of the present invention in cross-section.

In the drawing, numeral 1 denotes a fiber, numeral 2 denotes the surface of a fiber carrying a coating of synthetic material, and numeral 3 denotes the porous elastic polymeric reinforcing material.

EXAMPLE 1

A matted fiber fleece having a density of 0.14 g/cm$^3$ and consisting of 50 per cent by weight of polyester fibers capable of length reduction under heat influence and 50 per cent by weight of polyamide fibers (staple length of the fibers 30 mm, thickness of the fibers 1.3 dtex) is soaked in a liquid containing 70 g of a 22 per cent aqueous dispersion of octadecyl ethylene urea ("Primenit" LD, a product of Farbwerke Hoechst AG., Frankfurt-Hoechst, Germany) per liter of water. The bath ratio is 1 : 20. The fleece is then squeezed off, dried for 10 minutes in a tenter drier by the action of heat at 110° C., and finally treated for 2 minutes at 140° C. in the tenter drier, thus causing a cross-linking of the coating substance on the surface of the fibers. The thus impregnated fleece is then soaked in known manner in a 50 per cent by weight aqueous dispersion of a butadiene/acrylonitrile/methacrylic acid terpolymer ("Perbunan" N 3405 M, a product of Farbenfabriken Bayer; Leverkusen, Germany), squeezed off, and then coagulated in known manner by heat action and dried for 20 minutes in a drying cabinet at 150° C. The fleece has a tear propagation resistance of 7 kg/mm (by IUP 8) and is very flexible. During tearing, a sliding of the elastomer from the fibers can be observed.

Proportion of elastomer: 58 per cent by weight.

The fleece produced in this manner may be used as a substrate for synthetic leather of the box sides type.

EXAMPLE 2

A fiber fleece according to Example 1 is soaked in a bath consisting of an 8 per cent by weight aqueous dispersion of dimethyl polysiloxane (Primenit SW, a product of Farbwerke Hoechst A.G., Frankfurt-Hoechst, Germany) and then squeezed off. The fleece is dried for 7 minutes by the action of warm air at 120° C. and then treated for 30 seconds with air at a temperature of 150° C. in a tenter drier. The softening characteristics imparted by this silicone treatment exceed the water-repellent properties. In the ensuing soaking process, the fleece is impregnated with a 50 per cent by weight aqueous dispersion of a butadiene-acrylonitrile-methacrylic acid terpolymer (Perbunan N 3405 M) which also contains 2.5 per cent by weight of titanium dioxide, and is then squeezed off. The fleece is then heated in a tenter drier, thus causing a coagulation of the polymer in the fleece. Very flexible fleeces having a tear propagation resistance between 8 and 10 kg/mm (by IUP 8) are thus obtained. The fleece produced in this manner is particularly suitable for use as a substrate from which synthetic leather is prepared which is comparable to leather of the box sides type in its mechanical properties. The elastomer content of the fleece is about 62 per cent by weight, based on the total weight of the fleece.

EXAMPLE 3

A fiber fleece corresponding to that used in Example 1 is impregnated with a liquid which contains, per liter of water, 70 g of cross-linkable hydrogen methyl polysiloxane (e.g. "Arkophob" SN, a product of Farbwerke Hoechst A.G., Frankfurt-Hoechst, Germany) and 7 g of zirconium oxychloride as a catalyst (bath ratio 1 : 20), then squeezed off, dried for 8 minutes at 120° C., and then treated for 3 minutes at a temperature of 150° C. in a tenter drier. By this treatment, the methyl polysiloxane disposed on the surface of the fibers is caused to cross-link. The fleece is then impregnated in known manner with a 50 per cent aqueous dispersion of a butadiene/acrylonitrile/methacrylic acid terpolymer (Perbunan N 3405 M) containing 2.5 parts by weight of titanium dioxide (calculated on the solids content), and then coagulated by heating to 38° to 40°C. A substantially complete separation of the elastomer from the fibers is thus achieved, which results in a tear propagation resistance of the fleece of 9 kg/mm (by IUP 8) and high flexibility.

Fleeces produced in this manner may be used as a base material for the production of a leather substitute of the box sides type.

The elastomer content of the fleece is about 61 per cent by weight, and its elasticity resembles that of natural box sides leather.

EXAMPLE 4*a*

A fiber fleece corresponding to that used in Example 1 is impregnated in a 30 per cent by weight aqueous dispersion of a cross-linkable polymer containing perfluorinated aliphatic side chains (so-called "Scotchgard" compounds, for example "Oleophobol" FC 218, a product of Chemische Fabrik Pfersee GmbH., Augsburg, Germany). The bath ratio is 1 : 20.

The thus impregnated fleece is squeezed off and then dried for 3 minutes at 120°C.

Subsequently, it is exposed for 2 minutes to a temperature of 150°C in a tenter drier, so that cross-linking of the polymer occurs.

Advantageously, the fleece is treated with a dilute solution of a wetting agent (e.g. "Marlon" A, a product of Chemische Werke Hüls A. G., Marl, Germany) before it is impregnated with a reinforcing material, thoroughly squeezed, and then soaked, while wet, with a 50 per cent aqueous dispersion of a butadiene/acrylonitrile/methacrylic acid terpolymer (Perbunan N 3405 M) containing 2.5 parts by weight of titanium dioxide, based on the solids content. In this manner, a completely uniform impregnation of the fleece is achieved. Due to the water and oil repellent qualities of the finished fleece, a separation of the elastomer from the fibers is achieved which yields tear propagation resistance values between 8 and 10 kg/mm (by IUP 8). The fleece may be used as a support for processing into a flexible leather substitute resembling a relatively coarse leather of the box sides type.

EXAMPLE 4*b*

A particularly uniform coverage of the fiber surface with the coating substance is achieved when using a cross-linkable polymer having perfluorinated aliphatic side chains, in combination with a polymer based on a melamine/formaldehyde precondensate (e.g. "Arkofix" NM, a product of Farbwerke Hoechst A.G., Frankfurt-Hoechst, Germany).

A fiber fleece of the type used in Example 1 is impregnated with a finishing bath containing 100 g of Arkofix NM, 10 g of magnesium chloride ($MgCl_2$) and 30 g of a cross-linkable polymer with perfluorinated aliphatic side chains (for example Oleophobol FC 218) per liter of water.

The fleece is squeezed off and dried for 3 minutes at 120°C. Then it is exposed for 2 minutes to a temperature of 150°C in a tenter drier, whereupon the precondensate condenses and enters into a cross-linking reaction with the cross-linkable polymer having the aliphatic side chains.

EXAMPLE 5

A fiber fleece such as the one used in Example 1 is impregnated with a liquid containing, per liter of water, 80 g of an urea/formaldehyde precondensate (Arkofix NHL, a product of Farbwerke Hoechst A.G., Frankfurt-Hoechst, Germany), 30 g of a product based on a cross-linkable polymer with perfluorinated aliphatic side chains (e.g. Oleophobol P 68, a product of Chemische Fabrik Pfersee, Augsburg, Germany), and 8 g of ammonium chloride.

The thus impregnated fleece is then squeezed off, dried for 5 minutes at 120°C, and then subjected for 2 minutes to a temperature of 150°C in a tenter drier, so that the urea/formaldehyde precondensate completes its condensation reaction and undergoes a cross-linking reaction with the cross-linkable polymer with perfluorinated side chains. The fleeces thus produced have very marked water- and oil-repellent qualities. Therefore, the impregnated fleece is advantageously first soaked in a solution of a wetting agent (e.g. Marlon A), thoroughly squeezed off, and then impregnated in the wet state with a 50 per cent aqueous dispersion of a butadiene/acrylonitrile/methacrylic acid terpolymer (Perbunan NT dispersion, a product of Farbenfabriken Bayer, Leverkusen, Germany) containing 2.5 per cent (based on the solids content) of titanium dioxide as a filler. The fleece is again squeezed off, then coagulated at a temperature of 40°C, washed, and finally dried at 150°C in a tenter drier.

The fleeces thus produced may be used as base materials for the production of a leather substitute which corresponds in its mechanical properties to leather of the box calf type. The tear propagation resistance values are around 8–9 kg/mm. The elastomer content of the fleece is 61 per cent, calculated on the total weight of the fleece.

EXAMPLE 6

A fiber fleece according to Example 1 is pretreated as described in Example 3, but instead of being impregnated with an elastomer dispersion as in Example 3 and then coagulated and so on, it is impregnated with a polyurethane solution (Caprolan a product of Lemfoerder Kunststoff GmbH., Lemfoerde, Germany), coagulated with water, and so on. Thus, in the present example, the material is pretreated with an aqueous dispersion and bonded with a polyurethane solution.

EXAMPLE 7

A matted fiber fleece consisting of 50 per cent by weight of polyester fibers capable of shrinking under heat influence and 50 per cent by weight of polyamide fibers (staple length 30 mm, titer 1.3 dtex) and having a density of 0.1 g/cm³ is impregnated with an aqueous dispersion containing 80 g of dimethyl polysiloxane (Primenit SW) per liter of water (bath ratio 1 : 30), then squeezed off, dried for 5 minutes at 120°C, and then treated for 2 minutes at 150°C in a tenter drier. Subsequently, the fleece is impregnated with a 50 per cent by weight aqueous dispersion of a butadiene/acrylonitrile/methacrylic acid terpolymer (Perbunan N 3405 M) having a solids content of 50 per cent, and the elastomer is then coagulated in known manner by heat action and dried at 150°C.

A very flexible fleece is thus produced which has a binder content of 65% and possesses a tear propagation resistance of 7 kg/mm (by IUP 8).

EXAMPLE 8

A matted fiber fleece consisting of 50 per cent by weight of polyester fibers capable of length reduction under heat influence and 50 per cent by weight of polyamide fibers (staple length 30 mm, titer 1.3 dtex) and having a density of 0.26 g/cm³ is impregnated with an aqueous dispersion containing 80 g of hydrogen methyl polysiloxane (Arkophob SN) and 8 g of zirconium oxychloride as a catalyst per liter of water. The bath ratio is 1 : 30. The fleece is then squeezed out and dried for 5 minutes at 120°C. Subsequently, a stream of air heated to 150°C is caused to act for 3 minutes upon the fleece. The fleece pretreated in this manner is impregnated in known manner with an aqueous dispersion of a butadiene/acrylonitrile/methacrylic acid terpolymer (Perbunan N 3405 M, solids content 50%) and the elastomer is then coagulated by heat action.

A complete separation of the elastomer from the fibers is thus achieved, and a tear propagation resistance of 15 kg/mm (by IUP 8). The binder content is about 54%. The fleece thus produced may be used as a substrate for the production of synthetic leather of the box calf type.

EXAMPLE 9

A matted fiber fleece consisting of 50 per cent by weight of heat-shrinkable polyester fibers and 50 per cent by weight of polyamide fibers, which has fibers of a staple length of 30 mm and a titer of 1.3 dtex, a weight per unit area of 250 g/m$^2$, and a density of 0.14 g/cm$^3$ and has been needled at a rate of 400 stitches per cm$^2$, is treated for 10 minutes, at room temperature, in a container filled with an impregnating liquid containing 30 g of phenol and 50 g of glycerol monostearate per liter of perchloroethylene. The bath ratio is 1 : 30. The fleece is then removed from the bath and rinsed in another bath filled with pure perchloroethylene, removed from this bath, and finally dried for 30 seconds at 120°C in a tenter drier. Subsequently, the fleece is impregnated in a trough containing a 50 per cent aqueous dispersion of a butadiene/acrylonitrile/methacrylic acid terpolymer (Perbunan N 3405 M), and the polymer is coagulated by heating the fleece to 38° to 40°C. The fleece treated in this manner is then dried for 15 minutes at 160°C in a drying cabinet. The tear propagation resistance (by IUP 8) of the material is 7 kg/mm. (For comparison: Fleeces bonded in the normal manner have tear propagation resistance values between 4 and 5 kg/mm.) During tearing, a sliding of the elastomer from the fibers can be observed, other than in the case of a normal elastomer bonding where a breaking of the fibers can be observed.

The fleece produced in this manner is suitable for use as a base material for synthetic leather of the box sides type.

EXAMPLE 10

The procedure described in Example 9 is repeated, except that the impregnating liquid applied to the fiber fleece during the first step of the process contains 10 g of phenol and 20 g of glycerol monostearate per liter of perchloroethylene.

EXAMPLE 11

The procedure described in Example 9 is repeated, except that the impregnating liquid contains 15 g of phenol and 30 g of glycerol monostearate per liter of perchloroethylene.

EXAMPLE 12

The procedure described in Example 9 is repeated, except that the impregnating liquid contains 40 g of phenol and 60 g of glycerol monostearate per liter of perchloroethylene.

EXAMPLE 13

A fiber fleece as described in Example 9 is treated in the manner described in said example with an impregnating liquid containing 30 g of phenol and 10 g of glycerol monostearate per liter of perchloroethylene. After a treatment of 10 minutes, the fleece is rinsed in pure perchloroethylene and then dried at room temperature in the open air. The fleece shows a considerable increase in weight, by up to more than 20 per cent by weight as compared with the untreated fleece, which is caused by a considerable swelling of the fibers. The cross-section of the polyamide fibers is extended by swelling, whereas the polyester fibers absorb the swelling agent or solvent without extending their cross-section. When kept at room temperature, the fibers remain swollen for a relatively long period of time.

The fleece treated as described above is impregnated in known manner with an aqueous dispersion of a butadiene/acrylonitrile/methacrylic acid terpolymer (Perbunan N 3405 M), then squeezed off to remove excess impregnating liquid, coagulated by heat treatment at 38° to 40°C, washed, and finally dried for 5 minutes at 160°C. During the drying process, the fibers are de-swollen, i.e. the swelling agents and solvents are evaporated from the fibers. The bonded fleeces thus produced are very flexible and their rolling and bending behavior resembles that of leather. The proportion of elastomer is about 60 per cent by weight, based on the total weight of the fleece. The resistance to tear propagation (measured according to IUP 8) is 8 kg/mm (box calf).

EXAMPLE 14

The procedure described in Example 13 is repeated, except that the impregnating liquid used in the first process step contains 40 g of phenol and 15 g of glycerol monostearate per liter of perchloroethylene.

EXAMPLE 15

The procedure described in Example 13 is repeated, except that the impregnating liquid contains 50 g of phenol and 20 g of glycerol monostearate per liter of perchloroethylene.

EXAMPLE 16

The procedure described in Example 13 is repeated, except that the impregnating liquid contains 60 g of phenol and 30 g of glycerol monostearate per liter of perchloroethylene.

By varying the proportions of the components in the impregnating liquid, the sliding properties of the fibers with respect to the binder are varied.

EXAMPLE 17

A matted fiber fleece as described in Example 9 is treated for 10 minutes in a liquid containing 50 g of phenol and 30 g of citric acid monostearate per liter of perchloroethylene.

Thereafter, it is rinsed with pure perchloroethylene and treated for 3 minutes with hot air of 150°C in a tenter drier. The thus pretreated fleece is then impregnated in known manner with a 50 per cent by weight aqueous dispersion of a butadiene/acrylonitrile/methacrylic acid terpolymer (Perbunan N 3405 M), coagulated, and dried for 15 minutes at 160°C in a tenter drier.

A supple fleece is thus produced which has a tear propagation resistance of 7 kg/mm (measured according to IUP 8) and may be used as a substrate for the production of synthetic leather of the box sides type.

EXAMPLE 18

A matted fiber fleece of the type described in Example 9 is treated for 8 minutes in a trough filled with an impregnating liquid which contains 30 g of phenol and 50 g of glycol monooleate per liter of perchloroethylene. Subsequently, the fleece is washed in pure perchloroethylene and exposed for 5 minutes to a temperature of 150°C in a tenter drier. The fleece is then impregnated with a 50 per cent by weight aqueous dispersion of a butadiene/acrylonitrile/methacrylic acid terpolymer (Perbunan N 3405 M), squeezed off, coagulated by heat action at 38° to 40°C, and dried for 15 minutes at 160°C.

The tear propagation resistance of the fleece thus produced is around 7 kg/mm (measured according to IUP 8).

It will be obvious to those skilled in the art that many modifications may be made within the scope of the present invention without departing from the spirit thereof, and the invention includes all such modifications.

What is claimed is:

1. A process for the production of a reinforced fiber fleece, comprising:

a. impregnating a non-woven fiber fleece with an impregnating liquid containing a synthetic coating substance, capable of forming a wash-proof union with the surfaces of said fibers, in an amount sufficient to coat said fibers, and an organic, non-elastic swelling agent, capable of swelling said fibers, in an amount sufficient to swell said fibers, b. rinsing the impregnated fibers to remove excess impregnating liquid, c. drying the rinsed, impregnated fibers for a period sufficient to evaporate that portion of the volatile components of said impregnating liquid within the pores between the coated fibers and form a wash-proof coating of said synthetic coating substance on said fibers, d. submerging the coated fibers in a liquid solution of an organic, polymeric elastic reinforcing material, having substantially no cohesion to said coating of said synthetic coating substance, in an amount sufficient to form a coherent structure essentially filling the pores between said coated fibers, e. coagulating said polymeric elastic reinforcing material to form a coherent, impregnated, reinforced fiber fleece, f. removing excess polymeric elastic reinforcing material, and g. heating said impregnated, reinforced fiber fleece at a temperature and for a period sufficient to evaporate the remainder of said volatile components of said impregnating liquid and substantially completely de-swell said impregnated fibers.

2. A process according to claim 1 in which the impregnating liquid comprises a liquid chlorinated aliphatic hydrocarbon, phenol, and citric acid monostearyl ester.

3. A process according to claim 1 in which the impregnating liquid comprises a liquid chlorinated aliphatic hydrocarbon, phenol, and glycerol monooleate.

4. A process according to claim 1 in which the impregnating liquid comprises a liquid chlorinated aliphatic hydrocarbon, phenol, and glycerol distearate.

5. A process according to claim 1 in which the impregnating liquid comprises a liquid chlorinated aliphatic hydrocarbon, phenol, and erythritol monopalmitate.

6. A process according to claim 1 in which the impregnating liquid comprises a liquid chlorinated aliphatic hydrocarbon, phenol, and sorbitol monostearate.

7. A process according to claim 1 in which the impregnating liquid comprises a liquid chlorinated aliphatic hydrocarbon, phenol, and sorbitol distearate.

8. A process according to claim 1 in which the liquid chlorinated hydrocarbon contained in the impregnating liquid is unsaturated.

9. A process according to claim 1 in which the liquid chlorinated hydrocarbon contained in the impregnating liquid is perchloroethylene.

10. A process according to claim 1 in which the impregnating liquid comprises a liquid chlorinated aliphatic hydrocarbon, phenol, and glycerol monostearate.

11. A process in accordance with claim 1 wherein the quantity of coating substance exceeds that of the swelling agent.

12. A process according to claim 11 wherein the first drying step is carried out at a temperature of about 100° to 180°C for a period of about 10 seconds to 10 minutes.

13. A process in accordance with claim 1 wherein the quantity of coating substance is at least equal to that of the swelling agent.

14. A process in accordance with claim 1 wherein the quantity of swelling agent exceeds that of the coating substance.

15. A process in accordance with claim 14 wherein the first drying step is carried out at room temperature.

16. A process in accordance with claim 1 wherein the impregnating liquid contains an organic solvent.

17. A process in accordance with claim 16 wherein the solvent is a liquid halogenated aliphatic hydrocarbon.

18. A process in accordance with claim 1 wherein the impregnated fibers are rinsed with an organic solvent.

19. A process in accordance with claim 1 wherein the coating substance is a material selected from the group consisting of an ester of a higher fatty acid and a polyhydric aliphatic alcohol and a multivalent aliphatic carboxylic acid and a long-chain aliphatic alcohol.

20. A process in accordance with claim 1 wherein the swelling agent is a benzene compound with at least one free phenolic OH group.

21. A process in accordance with claim 1 wherein the second drying step is carried out at a temperature of about 100° to 180°C for a period of about 2 to 30 minutes.

22. A process in accordance with claim 1 wherein the coating substance is used in a ratio of about 2 to 20 per cent by weight, based on the weight of the filler-less fleece.

23. A process in accordance with claim 17 wherein the halogenated aliphatic hydrocarbon is a liquid chlorinated hydrocarbon.

* * * * *